United States Patent [19]

Allen

[11] 4,083,459

[45] Apr. 11, 1978

[54] MOUNTING APPARATUS FOR A COUNTERWEIGHT ASSEMBLY

[75] Inventor: Jan K. Allen, Chillicothe, Ill.

[73] Assignee: Caterpillar Tractor Co., Peoria, Ill.

[21] Appl. No.: 789,479

[22] Filed: Apr. 21, 1977

[51] Int. Cl.[2] ..... B66C 23/00

[52] U.S. Cl. ..... 212/8 B; 212/49; 214/1 PA; 214/142

[58] Field of Search ..... 212/144, 8 R, 8 B, 49, 212/59 R; 214/142, 1 P, 1 PA

[56] References Cited

U.S. PATENT DOCUMENTS

| | | | |
|---|---|---|---|
| 1,985,285 | 12/1934 | Erdahl | 212/49 |
| 2,722,320 | 11/1955 | Dobeus et al. | 212/49 |
| 3,236,391 | 2/1966 | Kennedy | 212/49 |
| 3,378,148 | 4/1968 | Stanley | 212/49 |
| 3,785,503 | 1/1974 | Butterfield et al. | 212/8 B |

FOREIGN PATENT DOCUMENTS

| | | | |
|---|---|---|---|
| 208,133 | 10/1955 | Australia | 214/142 |

*Primary Examiner*—Lawrence J. Oresky
*Attorney, Agent, or Firm*—John W. Grant

[57] ABSTRACT

A crawler vehicle has a main frame and first and second track assemblies disposed at opposite sides of the main frame. Each of the track assemblies has a roller frame. A mounting apparatus is provided for fastening a counterweight assembly to the vehicle on the outboard side of the first track assembly. The mounting apparatus includes a first pair of brackets secured to the main frame adjacent the first track assembly and a second pair of brackets secured to the outboard side of the roller frame of the first track assembly. A frame assembly has first and second arms with the first arm being positioned generally vertically between the main frame and the first track assembly and the second arm projecting laterally outwardly relative to the first arm and over the first track assembly. A first pin connects the first arm of the frame assembly to the first pair of brackets. A second pin detachably fastens the lower end of a counterweight mounting frame to the second pair of brackets. A third pin detachably fastens the upper end portion of the mounting frame to the second arm of the frame assembly. The counterweight assembly is attached to the mounting frame for swinging movement in the substantially horizontal pathway between a retracted position at which a first portion of the counterweight is disposed above the forward end of the first track assembly and an extended position at which at least a greater portion of the counterweight is positioned outwardly from the extremity of the first track assembly.

6 Claims, 4 Drawing Figures

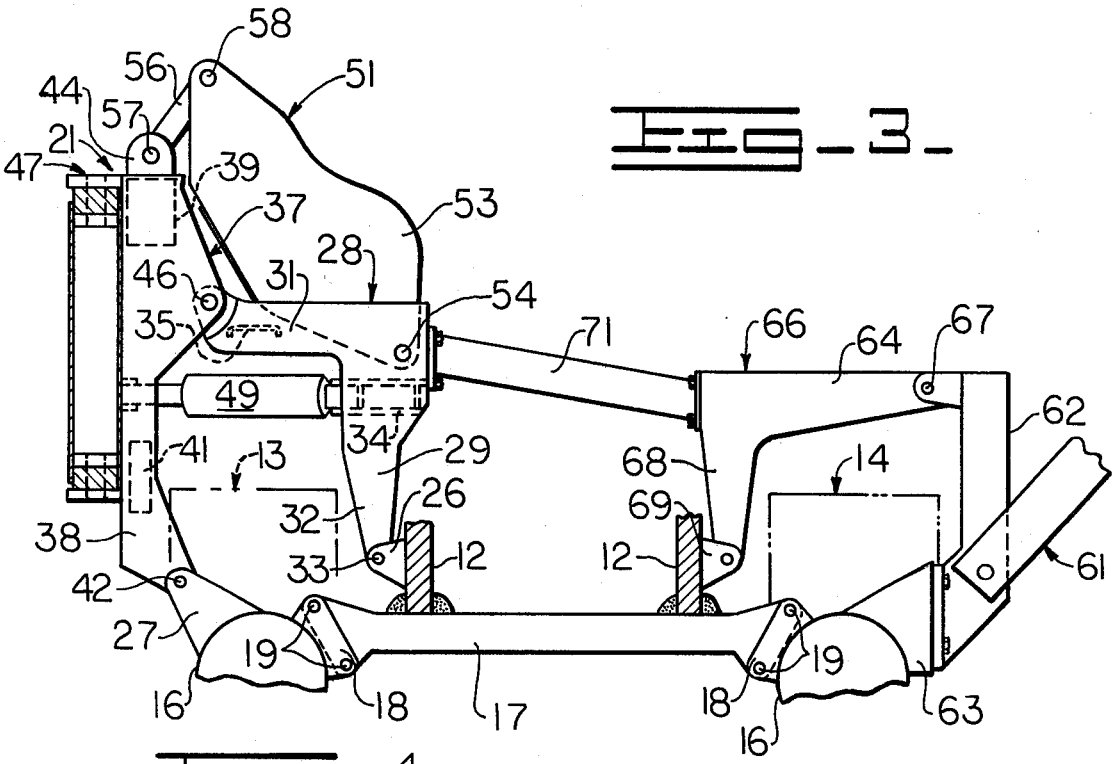
Fig. 3
Fig. 4
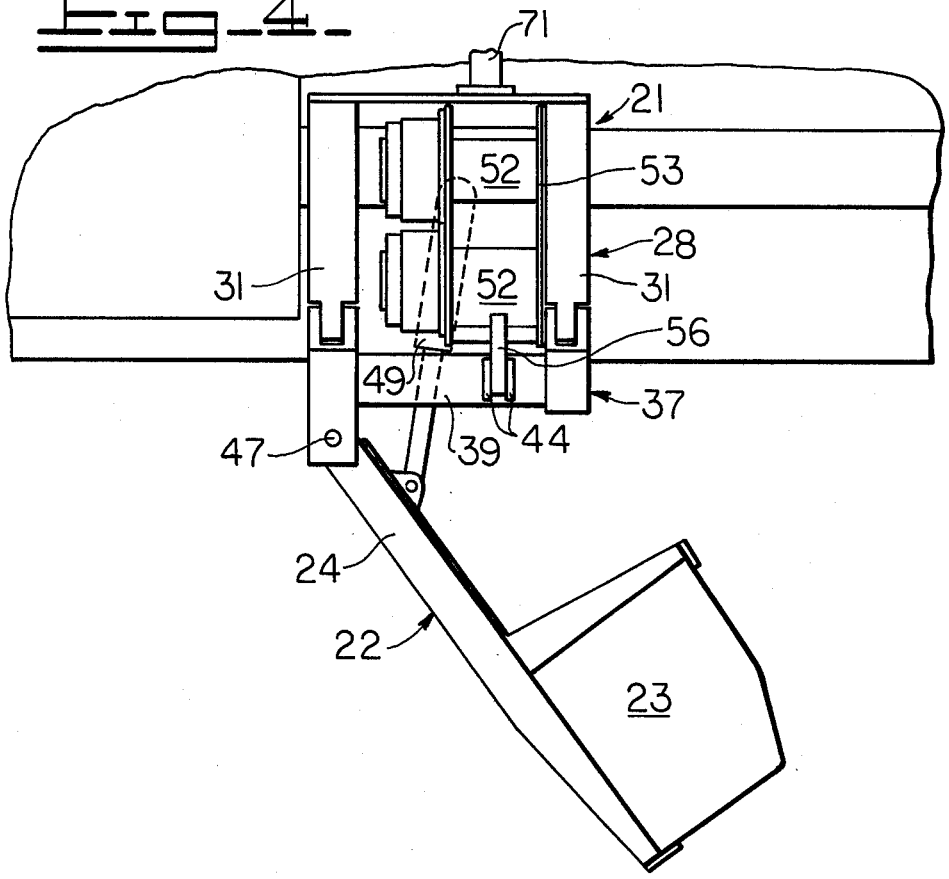

MOUNTING APPARATUS FOR A COUNTERWEIGHT ASSEMBLY

BACKGROUND OF THE INVENTION

This invention relates to a crawler pipelayer and more particularly to the mounting apparatus for attaching the counterweight to the basic crawler vehicle.

Many pipelayers are mounted on crawler vehicle chassis and typically have a boom assembly mounted on one side of the vehicle and a counterweight assembly mounted on the opposite side. Such assembled pipelayers almost always exceed the allowable width and weight for shipment and thus the boom and counterweight assemblies must be removed for shipping and then reinstalled at the job site. This has become an increasing problem as the size of the pipelayers increase since the couterweight and boom assemblies may weigh several tons and are cumbersome to handle during both the removal and subsequent reinstallation operation. Another problem encountered with many pipelayers is that other components are necessarily mounted to the counterweight support structure. Thus removal of the support structure to achieve the minimum shipping width frequently necessitates disconnecting many hydraulic lines and linkages thereby increasing the time and complexity of preparing the vehicle for shipment and the subsequent reinstalling of the components.

SUMMARY OF THE INVENTION

The present invention is directed to overcoming one or more of the problems as set forth above.

According to the present invention there is provided in a crawler vehicle having a main frame extending along a longitudinal axis of the vehicle, first and second track assemblies disposed at opposite sides of the main frame with each of the track assemblies having a roller frame, a counterweight assembly, a mounting apparatus for fastening the counterweight assembly to the vehicle on the outboard side of the first track assembly. The mounting apparatus comprises a first pair of brackets secured to the main frame adjacent the first track assembly, said brackets being longitudinally spaced. A second pair of brackets is secured to the outboard side of the roller frame of the first track assembly and are longitudinally spaced. A frame assembly has first and second arms, said first arm being positioned generally vertically between the main frame and the first track assembly and said second arm projecting laterally outwardly relative to the first arm and over the first track assembly. A first pin means connects the first arm of the frame assembly to the first pair of brackets. A counterweight mounting frame has an upper portion and a lower end portion. A second pin means detachably fastens the lower end portion of the mounting frame to the second pair of brackets. A third pin means detachably fastens the upper portion of the mounting frame to the second arm means. A means is provided for pivotally attaching the counterweight assembly to the mounting frame for swinging movement in a substantially horizontal pathway between a retracted position at which a first portion of the counterweight assembly is disposed above the forward end of the first track assembly and an extended position at which at least a greater portion of the counterweight assembly is positioned outwardly from the extremity of the first track assembly.

BRIEF DESCRIPTION OF THE DRAWINGS

FIG. 3 is a sectional view taken along line III—III of FIG. 2; and

FIG. 4 is a plan view of the mounting apparatus with the counterweight in an extended position.

DETAILED DESCRIPTION OF THE INVENTION

Figure 1:
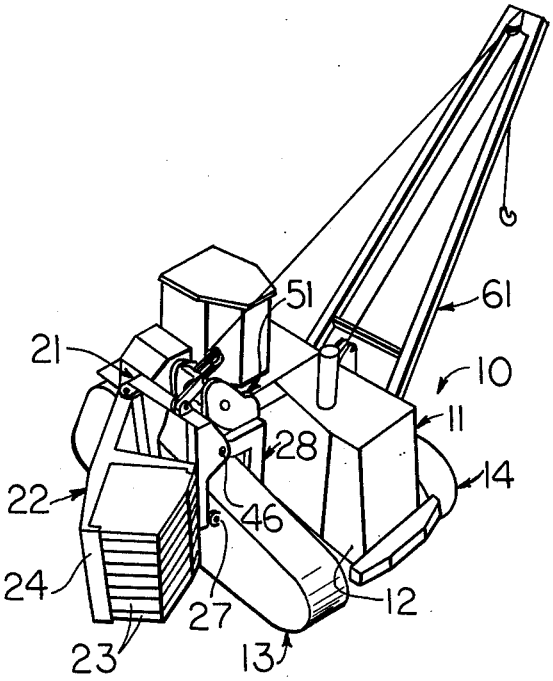
FIG. 1 is a perspective view of a pipelayer on which the mounting apparatus of the present invention is employed.
Figure 2:
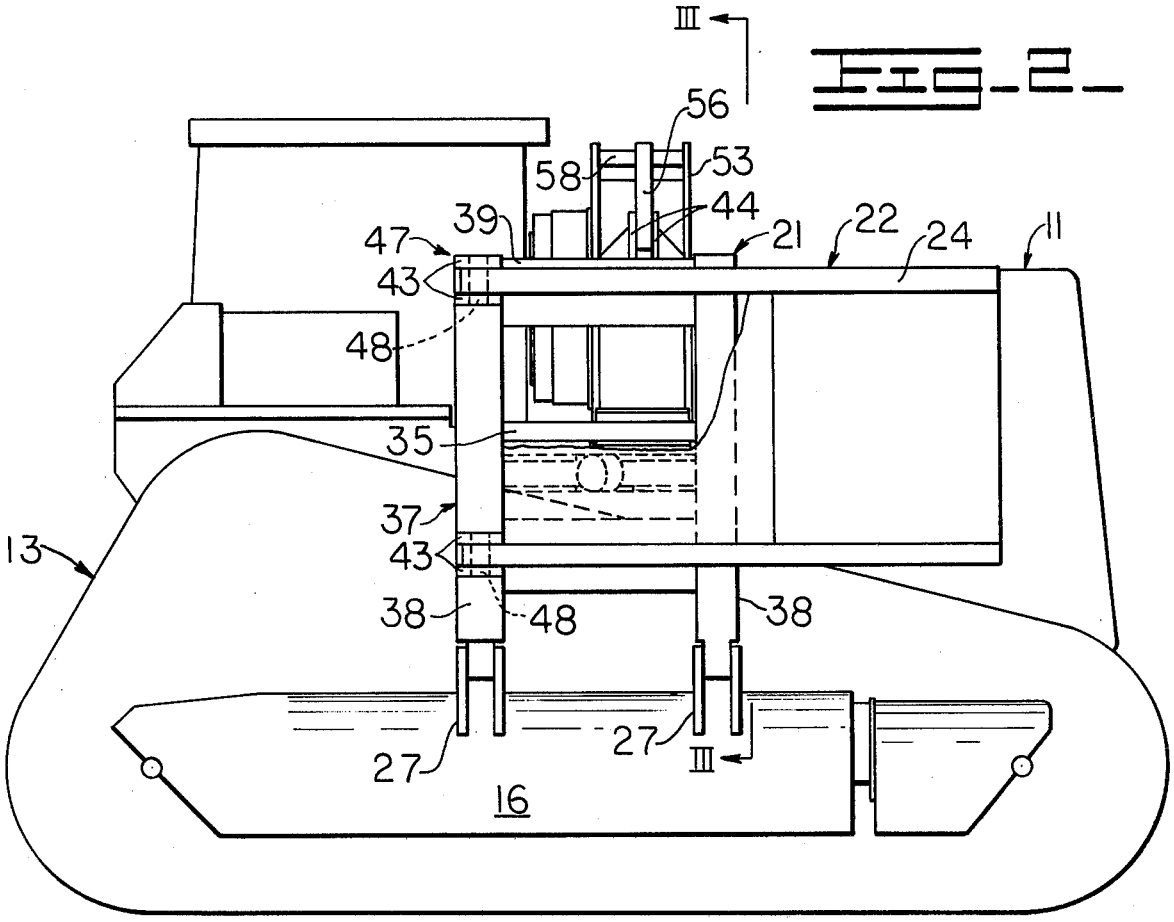
FIG. 2 is a side elevational view of the mounting apparatus of FIG. 1.

Referring now to FIGS. 1 and 2 a pipelayer generally indicated by the reference numeral 10 includes a crawler vehicle 11 having a main frame 12 extending along a longitudinal axis of the vehicle. A pair of track assemblies 13 and 14 are disposed on opposite sides of the main frame. Each track assembly includes a roller frame 16 each of which is interconnected to the other through a laterally extending hard bar 17 as best shown in FIG. 3. Each end of the hard bar is disposed between a pair of longitudinally spaced lugs, one shown at 18, which are secured to the inboard side of the roller frame. Each end of the hard bar is connected to the respective pair of lugs by a pair of pins 19. The pins are positioned parallel to the longitudinal axis of the vehicle. The hard bar is secured, as by welding, to the underneath side of the main frame adjacent to the forward end of the vehicle.

A mounting apparatus 21 is provided for fastening a counterweight assembly 22 to the vehicle on the outboard side of the track assembly 13. The counterweight assembly includes a plurality of counterweights 23 carried on a support structure 24.

The mounting apparatus 21 includes a first pair of brackets, one shown at 26 in FIG. 3 secured to the main frame 12 adjacent to the track assembly 13. The brackets are longitudinally spaced from each other. A second pair of brackets 27 are secured to the outboard side of the roller frame 16 of the track assembly 13. As shown in FIG. 2, the brackets are longitudinally spaced from each other.

A frame assembly 28 is a fabricated structure and has a first pair of arms 29 and a second pair of arms 31. The first arms are longitudinally spaced and are positioned generally vertically between the main frame 12 and the track assembly 13. Each of the first arms has a lower end portion 32 connected to one set of the brackets 26 by a first pin 33. Each of the second arms project laterally outwardly relative to the first arms and over the track assembly 13. A first structural member 34 extends between the first pair of arms 29 while a second structural member 35 extends between the second pair of arms 31.

A counterweight mounting frame 37 is also a fabricated structure and includes a pair of vertically extending longitudinally spaced legs 38 which are interconnected by a pair of vertically spaced longitudinally extending braces 39 and 41. A lower end of each leg is connected to one of the second pair of brackets 27 by a second pin 42. Two pair of vertically spaced ears 43 project outwardly from the rear leg while a pair of lugs 44 project upwardly from the upper brace 39. Each of the outer ends of the second arms 31 are detachably fastened to the upper portion of the counterweight mounting frame by a third pin 46.

A hinge means 47 attaches the rearward end portion of the support structure 24 of the counterweight assemby 22 to the mounting frame 37 for swinging movement in a substantially horizontal pathway between a retracted position in which a larger portion of the counterweights 23 are positioned above the forward end of the track assembly 13 and an extended position in which the counterweights are disposed outwardly beyond the extremity of the track assembly. The hinge means includes a pair of vertically oriented axially aligned hinge pins 48 which pivotally fasten the rearward end portion of the support structure 24 to the ears 43.

A fluid jack 49 is pivotally fastened to the first member 34 of the frame assembly 37 and has its rod end pivotally connected to the support structure 24 of the counterweight assembly 22. Extending the jack causes the counterweights to be swung from the retracted position to the extended position.

A winch mechanism 51 includes a pair of power driven winches 52 suitably mounted to a winch support structure 53. The lower end of the winch support structure is pin connected to the frame assembly 28 by a pin 54 while the upper outer end is connected to the lugs 44 of the mounting frame 37 through a link 56 and a pair of pins 57 and 58.

Referring to FIGS. 1 and 3, a boom assembly 61 is disposed at the opposite side of the crawler vehicle 11. The boom assembly is pivotally mounted to a boom mounting frame 62 which has its lower end secured to a bracket 63 extending outwardly from the roller frame 16 of the track assembly 14. The upper end of the boom mounting frame is connected to a outwardly projecting arm 64 of a frame assembly 66 by a pin 67. A downwardly projecting arm 68 is pinned to a bracket 69 secured to the main frame 12 adjacent the track assembly 14. A rigid cross member 71 has its opposite ends secured to the frame assemblies 28 and 66.

Referring to FIG. 3, it is clearly shown that the second brackets 27 and the outermost portion of the frame assembly 28 are inboard of the outermost extremities of the track assembly 13. Likewise, the bracket 63 and the outermost portion of the boom mounting frame 62 are within the outermost extremities of the track assembly 14. Thus, to prepare the vehicle for shipment, the counterweight mounting frame 37 and counterweight assembly 22 may be separated from the crawler vehicle as a unit. To separate the mounting frame from the vehicle, the pin 57 is removed and the winch mechanism 51 lowered to rest on the connecting member 31 and the rod end of the fluid jack 49 unfastened from the support structure 24. The second pins 42 and third pins 46 are then removed so that the mounting frame is disconnected from the frame assembly 28 and second brackets 27. The mounting frame and thus the counterweight assembly are subsequently reinstalled by performing the above steps in reverse order.

The boom assembly 61 and boom mounting frame 62 can be similarly disconnected from the brackets 63 and frame assembly 66. Thus, with the counterweight assembly 22, mounting frame 37, boom assembly 61 and boom mounting frame 62 removed from the vehicle, the maximum shipping width is determined by the outer extremities of the track assemblies 13 and 14.

Other aspects, objects and advantages of this invention can be obtained from a study of the drawings, the disclosure and the appended claims.

The embodiment of the invention in which an exlusive property or privilege is claimed are defined as follows:

1. In a crawler vehicle having a main frame extending along a longitudinal axis of the vehicle, first and second track assemblies disposed at opposite sides of a main frame with each of the track assemblies having a roller frame, a counterweight assembly, and including a mounting apparatus for fastening the counterweight assembly to the vehicle on the outboard side of the first track assembly, the improvement comprising:

a first pair of brackets secured to the main frame adjacent the first track assembly, said brackets being longitudinally spaced;

a second pair of brackets secured to the outboard side of the roller frame of the first track assembly, said brackets being longitudinally spaced;

a frame assembly having first and second arms, said first arm being positioned generally vertically between the main frame and the first track assembly, and said second arm projecting laterally outwardly relative to the first arm and over the first track assembly;

a first pin connecting the first arm of the frame assembly to the first pair of brackets;

a counterweight mounting frame having an upper portion and a lower end portion;

a second pin detachably fastening the lower end portion of the counterweight mounting frame to the second pair of brackets;

a third pin detachably fastening the upper portion of the counterweight mounting frame to the second arm; and hinge means for attaching the counterweight assembly to the mounting frame for swinging movement in a substantially horizontal pathway between a retracted position at which a first portion of the counterweight assembly is disposed above the forward end of the first track assembly and an extended position at which at least a greater portion of the counterweight is positioned outwardly from the extremity of the first track assembly.

2. The combination of claim 1 including a fluid jack extending between and pivotally fastened to the frame assembly and the counterweight assembly and being of a construction sufficient for swinging the counterweight assembly between the retracted and extended positions.

3. The combination of claim 2 including a winch mechanism and means for fastening the winch mechanism to the frame assembly.

4. The combination of claim 3 wherein said winch mechanism fastening means includes a pin, and including a link having first and second ends, the first end being connected to the winch mechanism and the second end being detachably connected to the upper portion of the mounting frame.

5. The combination of claim 4 including a boom assembly, means for attaching the boom assembly to the outboard side of the second track assembly, and a laterally extending cross member having first and second ends, said first end being fastened to the boom assembly mounting means and the second end being connected to the frame assembly.

6. The combination of claim 1 wherein all portions of the second arm of the frame assembly and the second pair of brackets are within the outermost side extremity of the first track assembly.

* * * * *